US007663320B2

(12) United States Patent
Kim et al.

(10) Patent No.: US 7,663,320 B2
(45) Date of Patent: Feb. 16, 2010

(54) DISPLAY APPARATUS AND CONTROL METHOD THEREOF

(75) Inventors: Hyung-rae Kim, Seoul (KR); Hoon Choi, Hwaseong-si (KR); Jun-ho Sung, Seoul (KR); Ki-bum Seong, Anyang-si (KR); Jun-ho Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 90 days.

(21) Appl. No.: 11/764,254

(22) Filed: Jun. 18, 2007

(65) Prior Publication Data

US 2008/0088243 A1 Apr. 17, 2008

(30) Foreign Application Priority Data

Oct. 16, 2006 (KR) ..... 10-2006-0100359

(51) Int. Cl.
*H05B 37/02* (2006.01)

(52) U.S. Cl. ..... 315/156; 315/157; 315/158; 315/307

(58) Field of Classification Search ..... 315/149, 315/155, 156, 157, 158, 159, 169.3, 291, 315/307, 308
See application file for complete search history.

(56) References Cited

U.S. PATENT DOCUMENTS

| | | | |
|---|---|---|---|
| 2006/0022935 | A1 | 2/2006 | Sakai et al. |
| 2006/0125773 | A1 * | 6/2006 | Ichikawa et al. ..... 345/102 |

FOREIGN PATENT DOCUMENTS

| | | | |
|---|---|---|---|
| CN | 1591109 | A | 3/2005 |
| CN | 1755447 | A | 4/2006 |
| JP | 05-249918 | A | 9/1993 |
| JP | 2005-241678 | A | 9/2005 |
| KR | 10-2006-0001694 | A | 1/2006 |
| KR | 10-2006-0043823 | A | 5/2006 |

* cited by examiner

*Primary Examiner*—David Hung Vu
(74) *Attorney, Agent, or Firm*—Sughrue Mion, PLLC

(57) ABSTRACT

A display apparatus having a displaying part on which an image is displayed, includes: a backlight unit comprising a plurality of light emitting elements that emit different color light which illuminates the displaying part, the plurality of light emitting elements being arranged in a predetermined pattern; a driving part that applies driving current to the backlight unit to control the operation of the light emitting elements and the intensity of light emitted from each of the light emitting elements; a sensing part that senses the amount of light emitted from the backlight unit; and a controller that detects a level of driving current applied to the backlight unit by the driving part, and if the detected level of driving current exceeds a predetermined reference current level, controls the driving part to adjust the backlight unit based on the amount of light sensed by the sensing part.

20 Claims, 4 Drawing Sheets

DISPLAY APPARATUS AND CONTROL METHOD THEREOF

CROSS-REFERENCE TO RELATED APPLICATIONS

This application claims priority from Korean Patent Application No. 10-2006-0100359, filed on Oct. 16, 2006 in the Korean Intellectual Property Office, the disclosure of which is incorporated herein by reference.

BACKGROUND OF INVENTION

1. Field of Invention

Apparatuses and methods consistent with the present invention relate to a display and control thereof, more particularly to a display apparatus with a backlight unit including light emitting diodes (LEDs) which are capable of adjusting brightness for each of illumination regions, and a control method thereof.

2. Description of the Related Art

In recent years, display apparatuses such as liquid crystal display (LCD) monitors that employ backlight units to provide light to liquid crystal display panels are being widely used. The display apparatus can adjust brightness of an image by adjusting the intensity of light emitted from a backlight unit, and can adjust brightness region by region by using a backlight unit that comprises LEDs.

The amount of light emitted from the backlight unit is sensed by a sensor, and color of the light emitted from the backlight unit is kept constant by adjusting ratios of driving current (i.e., duty cycle) supplied to a red color (R) light emitting diode that emits red color light, a green color (G) light emitting diode that emits green color light, and a blue color (B) light emitting diode that emits blue color light, based on the sensed intensity of light.

A range in which the sensor senses the amount of light emitted from the backlight unit is wide. However, if the amount of light is suddenly changed, the sensor may not sense the amount of light precisely due to non-linearity of the sensor that produces about ±5% output errors. The non-linearity of the sensor may cause a phenomenon that color is suddenly changed by change of a screen due to erroneous color adjustment.

For example, if the amount of light is suddenly changed from 100 to 10 on the assumption that the amount of light emitted from the backlight unit is 0 to 100 and the sensor can sense a range of light amount of 10 to 100, the sensor can not sense the light amount of 10 precisely.

For the purpose of overcoming this problem, the conventional display apparatus sets a threshold value of the amount of light emitted from the backlight unit and adjusts color of the light emitted from the backlight only if the amount of light sensed by the sensor exceeds the threshold value.

However, since the backlight unit is much affected by temperature and use time, the amount of light may be decreased by increase of the temperature or deterioration due to extension of use time. If the amount of light is decreased due to deterioration of the backlight unit, and hence the amount of light sensed by the sensor is less than the threshold value, there may arise a problem of non-operation of color adjustment.

SUMMARY OF THE INVENTION

Accordingly, it is an aspect of the present invention to provide a display apparatus which is capable of adjusting color of an image stably even if the amount of light emitted from a backlight unit is decreased with increase of temperature or with long use time.

Additional aspects of the present invention will be set forth in part in the description which follows and, in part, will be obvious from the description, or may be learned by practice of the present invention.

The foregoing and/or other aspects of the present invention can be achieved by providing a display apparatus having a displaying part on which an image is displayed, comprising: a backlight unit comprising a plurality of light emitting elements that emit different color light which illuminates the displaying part, the plurality of light emitting elements being arranged in a predetermined pattern; a driving part that applies driving current to the backlight unit to control the operation of the light emitting elements and the intensity of light emitted from each of the light emitting elements; a sensing part that senses the amount of light emitted from the backlight unit; and a controller that detects a level of driving current applied to the backlight unit by the driving part, and if the detected level of driving current exceeds a predetermined reference current level, controls the driving part to adjust the backlight unit based on the amount of light sensed by the sensing part.

According to the embodiment of the present invention, the light emitting elements comprise a red color light emitting diode, a green color light emitting diode, and a blue color light emitting diode, and wherein the controller controls the driving part to adjust the intensity of light emitted from at least one of the red color light emitting diode, the green color light emitting diode, and the blue color light emitting diode, based on the amount of light that is emitted from the backlight unit and is sensed by the sensing part.

According to the embodiment of the present invention, the controller detects a level of driving current applied to a light emitting element, which is adjacent to the sensing part, of the plurality of light emitting diodes of the backlight unit.

According to the embodiment of the present invention, the display apparatus further comprises a signal input part to which an image signal is inputted, wherein the controller checks a gray scale of the inputted image signal and detects the level of driving current applied to the light emitting element adjacent to the sensing part, based on the checked gray scale.

According to the embodiment of the present invention, the controller sets weights to the light emitting elements depending on a distance from the sensing part, and detects the level of driving current applied to the light emitting element adjacent to the sensing part using the set weights and the gray scale for each illumination region of the backlight unit.

According to the embodiment of the present invention, if the number of times in which the level of driving current exceeds the reference current level is more than a predetermined number, the controller controls the driving part to adjust the backlight unit.

According to the embodiment of the present invention, if the gray scale is less than a reference gray scale, the controller controls the driving part to maintain the level of driving current applied to the backlight unit.

The foregoing and/or other aspects of the present invention can be achieved by providing a control method of a display apparatus having a displaying part on which an image is displayed, a backlight unit comprising a plurality of light emitting elements that emit different color light which illuminates the displaying part, the plurality of light emitting elements being arranged in a predetermined pattern, a driving part that applies driving current to the backlight unit to control operation of each light emitting element and control the intensity of light emitted from each of the light emitting elements, and a sensing part that senses the amount of light emitted from the backlight unit, the control method comprising: detecting a level of driving current applied to the backlight unit by the driving part; comparing the detected level of driving current with a predetermined reference current level; and if the detected level of driving current exceeds the predetermined reference current level, controlling the driving part to adjust the backlight unit based on the amount of light sensed by the sensing part.

According to the embodiment of the present invention, the light emitting elements comprise a red color light emitting diode, a green color light emitting diode, and a blue color light emitting diode, and wherein the controlling the driving part comprises adjusting the intensity of light emitted from at least one of the red color light emitting diode, the green color light emitting diode, and the blue color light emitting diode, based on the amount of light that is emitted from the backlight unit and is sensed by the sensing part.

According to the embodiment of the present invention, the detecting the level of driving current comprises detecting a level of driving current applied to a light emitting element, which is adjacent to the sensing part, of the plurality of light emitting diodes of the backlight unit.

According to the embodiment of the present invention, the control method further comprises inputting an image signal, wherein the detecting the level of driving current comprises: checking a gray scale of the inputted image signal; and detecting the level of driving current applied to the light emitting element adjacent to the sensing part, based on the checked gray scale.

According to the embodiment of the present invention, the detecting the level of driving current comprises: setting weights to the light emitting elements depending on a distance from the sensing part; and detecting the level of driving current applied to the light emitting element adjacent to the sensing part using the set weights and the gray scale for each illumination region of the backlight unit.

According to the embodiment of the present invention, the controlling the driving part comprises adjusting the backlight unit if the number of times in which the level of driving current exceeds the reference current level is more than a predetermined number.

According to the embodiment of the present invention, the controlling the driving part comprises maintaining the level of driving current applied to the backlight unit if the gray scale is less than a reference gray scale.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 1:
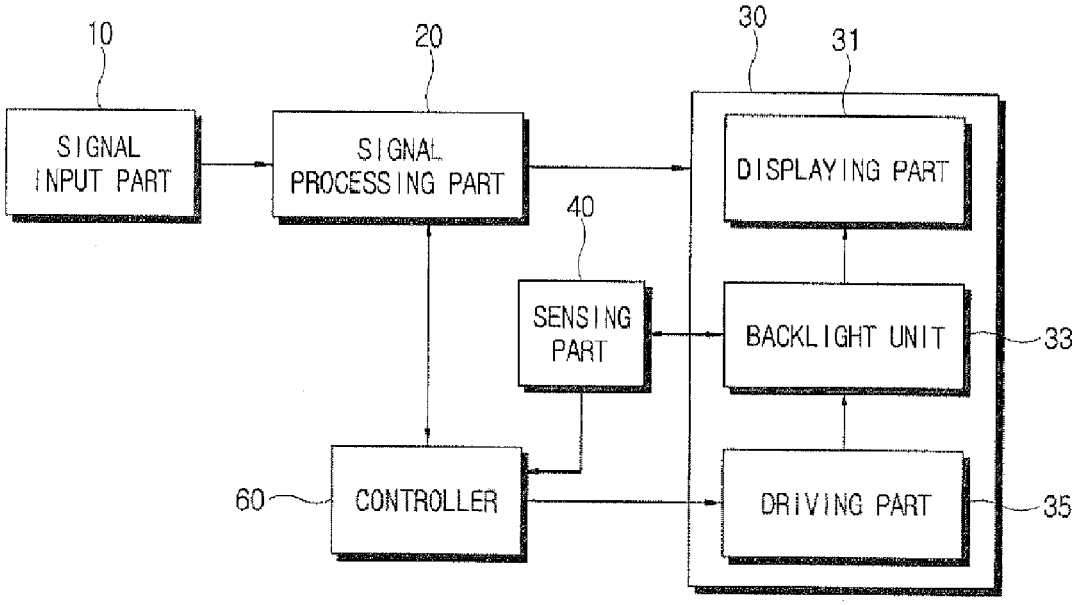
FIG. 1 is a control block diagram of a display apparatus according to an exemplary embodiment of the present invention.

Reference will now be made in detail to the embodiments of the present invention, examples of which are illustrated in the accompanying drawings, wherein like reference numerals refer to like elements throughout. The exemplary embodiments are described below so as to explain the present invention by referring to the figures.

FIG. 1 is a control block diagram of a display apparatus according to an exemplary embodiment of the present invention. As shown in FIG. 1, a display apparatus comprises a signal input part 10, a signal processing part 20, a display module 30, a sensing part 40, and a controller 60.

The signal input part 10 may comprise a tuner that receives a broadcasting signal and an external connection terminal through which an image signal is inputted from an external apparatus.

In this embodiment, the external connection terminal (not shown) may comprise various types of connectors through which image signal of various formats can be inputted. For example, the signal input part 10 may comprise at least one of a D-Sub connector, a composite video baseband signal (CVBS) connector, an S-video connector and a component connector.

The signal processing part 20 processes an image signal inputted from the signal input part 10 under control of the controller 60, which will be described later, and provides the processed image signal to the displaying part 31 on which an image is displayed based on the image signal. Particularly, the signal processing part 20 converts a level of a gray scale of the image signal using a luminance conversion table.

In addition, the signal processing part 20 may have various functions corresponding to various formats of the inputted image signal. For example, the signal processing part 20 may have an A/D converting function of converting an inputted image signal of various formats into a digital image signal of a specified format, a digital decoding function, a scaling function of adjusting a vertical frequency, resolution, picture aspect ratio, etc. for an inputted digital image signal and/or analog image signal in accordance with an output format of the displaying part 31, and a predetermined format converting function.

As shown in FIG. 1, the display module 30 comprises a displaying part 31, a backlight unit 33 and a driving part 35 and displays an image based on the image signal processed by the signal processing part 20.

The displaying part 31 may comprise a plurality of divided display regions, and may be embodied by various types of display devices such as a liquid crystal display (LCD), a plasma display panel (PDP) or the like.

Figure 2:
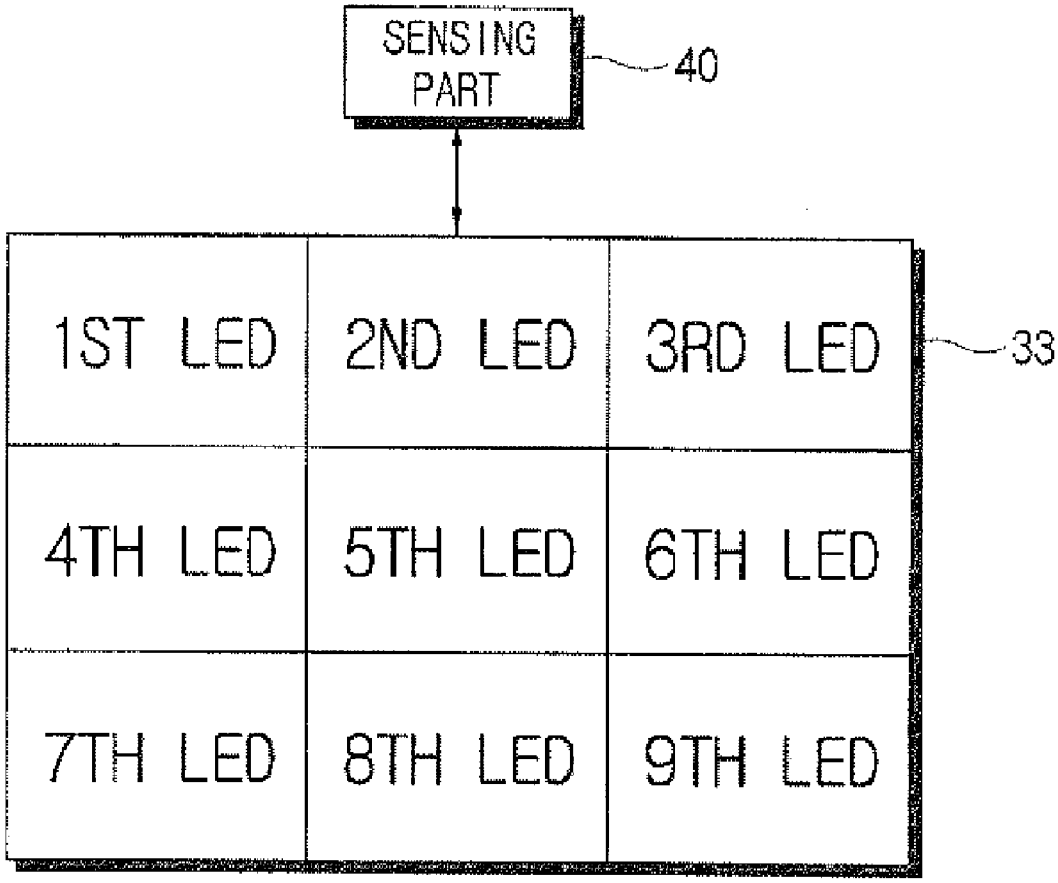
FIG. 2 is a drawing showing a backlight unit and a sensing part according to an exemplary embodiment of the present invention.

As shown in FIG. 2, the backlight unit 33 illuminates the displaying part 31 and has a plurality of illumination regions. The plurality of illumination regions illuminates the plurality of display regions of the displaying part 31.

In addition, the backlight unit 33 typically comprises a lamp as a light source, a light guide plate that converts light emitted from the lamp into surface light for improvement of light efficiency and luminance, and an optical sheet such as a prism sheet, a polarizing plate or the like.

In this embodiment, the lamp of the backlight unit 33 comprises a plurality of light emitting elements that emit light of different colors, that, preferably but not necessarily, may be a plurality of light emitting diodes. In addition, the light emitting diodes may comprise a red color light emitting diode (R-LED) that emits red color light, a green color light emitting diode (G-LED) that emits green color light, and a blue color light emitting diode (B-LED) that emits blue color light. It is more preferable, but not necessary, that the light emitting diodes comprise an integrated RGB light emitting diode that selectively emits red, green and blue color light. Accordingly, it is possible to widen a range of colors on a color coordinate system by which an image displayed on the displaying part 31 can be expressed, and achieve a high speed response time according to control of the driving part 35.

The R, G and B color light emitting diodes are arranged in the backlight unit 33 in a specified pattern. For example, the R, G and B color light emitting diodes may be sequentially arranged in a pattern of R-G-G-B-R-G-G-B-R-G-G-B, . . . in a horizontal direction of the displaying part 31, or may be optimally arranged, for example, in a pattern of R-G-B, . . . , R-R-G, . . . R-G-B-B, . . . in consideration of characteristics of the RGB color light emitting diodes (for example, maximum light brightness) in such a manner that an image displayed on the displaying part 31 is adapted to natural color expression.

In addition, the RGB color light diodes may be arranged in the maximum density to correspond to pixels of the displaying part 31. Accordingly, hue or luminance of an image displayed on the displaying part 31 is emphasized depending on the operating light emitting diode among the RGB light emitting diodes disposed behind the pixels, or the intensity of light thereof, leading to improvement of contrast.

The driving part 35 controls whether to operate each of the RGB diodes and adjusts the intensity of light emitted from each of the RGB color light emitting diodes under control of the controller 60. In this embodiment, the driving part 35 may adjust the intensity of light by adjusting the intensity of current applied to each of the RGB color light emitting diodes.

In addition, the driving part 35 may comprise a horizontal driving part (not shown) and a vertical driving part (not shown) that control the operation of each RGB light emitting diode and the intensity of light emitted from each of the RGB color light emitting diodes according to a control signal from the controller 60. It is to be understood that the operation of the RGB light emitting diodes and the intensity of light emitted from the RGB color light emitting diodes can be adjusted depending on a combination of the horizontal driving part (not shown) and the vertical driving part (not shown).

The sensing part 40 senses the amount of light emitted from the backlight unit 33 and provides brightness information related to the sensed amount of light to the controller 60. In addition, the sensing part 40 may be disposed adjacent to one of the light emitting diodes of the backlight unit 33. For example, as shown in FIG. 2, the sensing part 40 may be disposed adjacent to the second LED among the first to ninth LEDs.

The controller 60 detects a level of driving current applied to the backlight unit 33 by the driving part 35, and if the detected level of driving current exceeds a predetermined reference level of current, adjusts the intensity of light emitted by the respective LEDs based on the brightness information related to the sensed intensity of light. The controller 60 may be embodied by a controller such as a central processing unit (CPU), a microcomputer, and other known control devices in the art.

Specifically, the controller 60 checks a level of driving current applied from the driving part 35 to an LED, which is adjacent to the sensing part 40, of the plurality of LEDs of the backlight unit 33.

For example, as shown in FIG. 2, if the backlight unit 33 has nine LEDs (the first to ninth LEDs), the controller 60 checks a level of driving current applied to the second LED closest to the sensing part 40.

In addition, the controller 60 may set predetermined weights to the plurality of LEDs of the backlight unit 33, and check the level of applied driving current using the set weights and a level of gray scale of an image signal. In this embodiment, the weights can be set randomly, but may be set depending on a distance from the sensing part 40.

Figure 3:
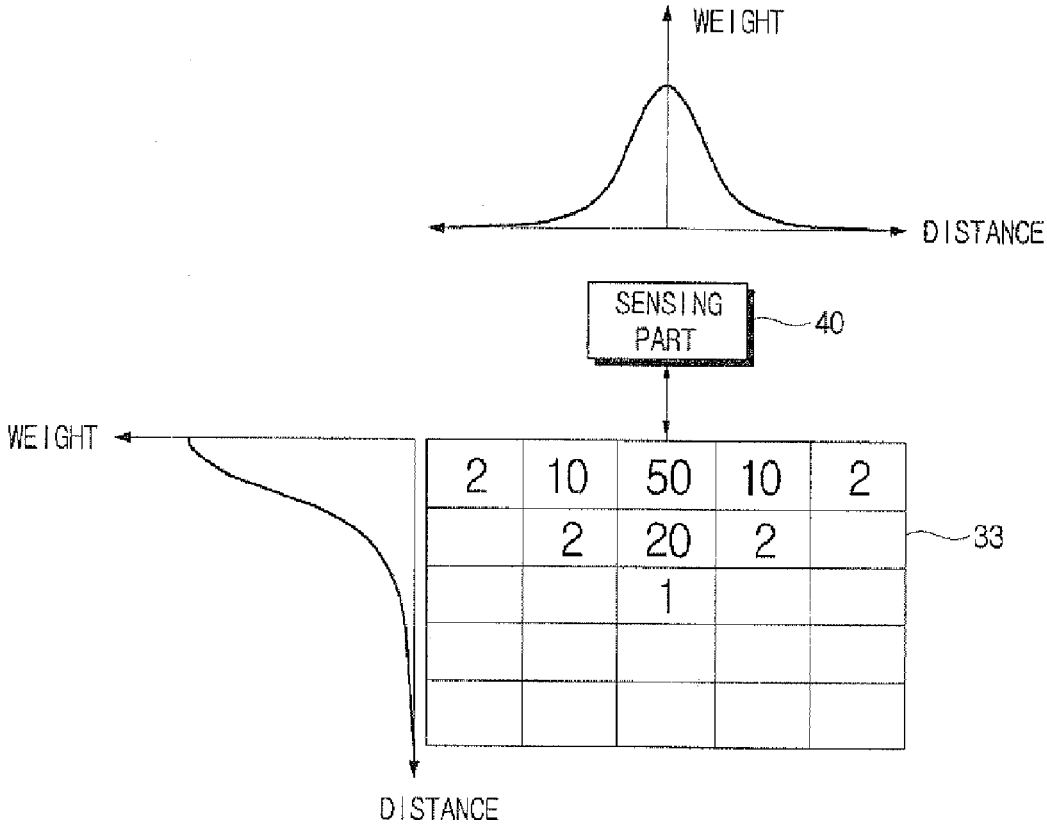
FIG. 3 is a drawing showing weights set in an illumination region of a backlight unit according to an exemplary embodiment of the present invention.

FIG. 3 is a view showing weights set depending on the distance from the sensing part 40. As shown in FIG. 3, a larger weight is set as the distance from the sensing part 40 becomes short while a smaller weight is set as the distance from the sensing part 40 becomes long. This indicates the longer the distance between the sensing part 40 and an illumination region is, the less affected the sensing part 40 is although each illumination region has the same brightness. In this case, the controller 60 varies the level of driving current from the minimum level (for example, 0) to the maximum level (for example, 255) for each of the plurality of LEDs, and accordingly, may detect the amount of light sensed by the sensing part 40 and set the weights precisely. In addition, it is to be understood that the set weights may be stored in a memory (not shown).

For example, as shown in FIG. 3, if a gray scale corresponding to an illumination region with a weight of 50 is 30, a level of driving current applied to this illumination region may be calculated as follows.

$$30*50/100=15 \text{ levels}$$

where, 30 is a gray scale, 50 is a weight of a corresponding LED, and 100 is the sum of weights of the overall LEDs.

Thus, the level of driving current applied by the driving part 35 to the LEDs adjacent to the sensing part 40 can be obtained by calculating weighted levels of driving current for all the LEDs and summing up the calculated levels of driving current.

In addition, the controller 60 determines whether or not the level of driving current applied to the LED adjacent to the sensing part 40 exceeds the reference current level. In this embodiment, the reference current level is a reference value based on which the sensing part 40 adjusts a light emission ratio (i.e., a duty cycle) of each light emitting diode of the backlight unit 33.

In addition, if the controller 60 determines that the level of driving current exceeds the reference current level, it checks the sensed amount of light emitted from the backlight unit 33. Then, the controller 60 controls the driving part 35 to adjust the light emission ratio (duty cycle) of each light emitting diode based on the checked amount of light. In this embodiment, since the intensity of light of the respective LED in emitted from the backlight unit 33 is adjusted based on an image being currently inputted, the adjusted intensity of light is in feedback and referred to at the next color adjustment of the backlight unit 33.

On the contrary, if the controller determines that a gray scale of an image signal is less than a reference gray scale, it controls the driving part 35 to maintain color of the light emitted from the backlight unit 33.

For example, if the gray scale is more than the reference gray scale and a percentage of a green color component of the sensed light emitted from the backlight unit 33 is low, the controller 60 controls the driving part 35 to increase driving current applied to the G-LED.

On the other hand, the controller 60 counts the number of times by which the gray scale exceeds the reference gray scale, and if the counted number of times exceeds a predetermined number, controls the driving part 35 to adjust color of an image displayed on the displaying part 31.

Thus, since the level of driving current applied to the backlight unit 33 is taken as a reference for adjusting color of the light emitted from the backlight unit 33, the color of the light may be adjusted even if the amount of light is decreased due to deterioration of the backlight unit 33. In other words, it is possible to overcome the problem that color can not be adjusted if the amount of light emitted from the backlight unit 33 is low although the same level of driving current is applied to the backlight unit 33 since the conventional display apparatus determines whether to adjust a color by the brightness detected by the sensing part 40.

Figure 4:
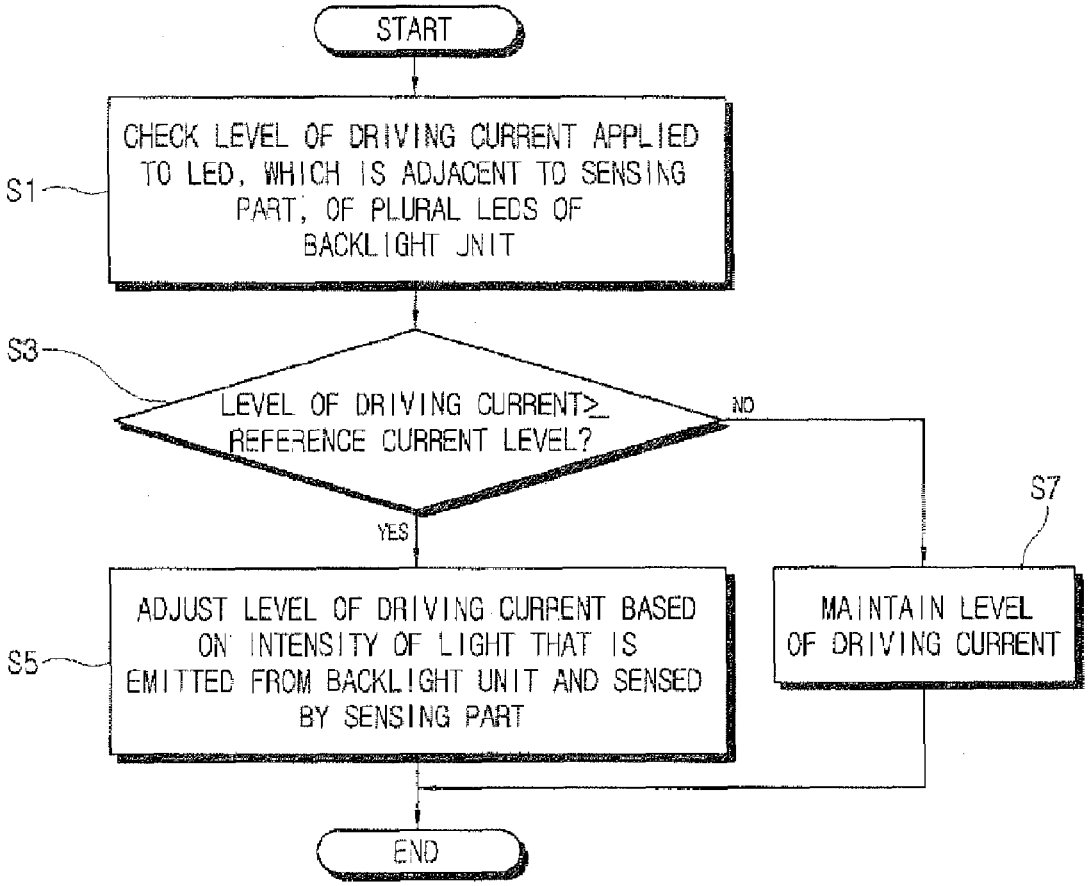
FIG. 4 is a flow chart illustrating an operation of the display apparatus according to the exemplary embodiment of the present invention.

Hereinafter, a control method of the display apparatus according to the above exemplary embodiment will be described with reference to a flow chart shown in FIG. 4.

As shown in FIG. 3, a gray scale of an image displayed on a display region corresponding to an LED, which is adjacent to the sensing part 40, of the LEDs of the backlight unit 33 is checked at operation S1.

As described above, the controller 60 checks a level of driving current applied to the LED closest to the sensing part 40, or checks the current level using the weights assigned to the LEDs depending on the distance from the sensing part 40.

Next, it is determined whether or not the checked level of driving current exceeds the reference current level at operation S3.

If it is determined at the operation S3 that the checked level of driving current exceeds the reference current level, the controller 60 controls the driving part 35 to adjust the light emission ratio (duty cycle) of each RGB color LED based on the sensed intensity of light emitted from the backlight unit 33 at operation S5.

On the contrary, if it is determined at the operation S3 that the checked level of driving current is less than the reference current level, the controller 60 controls the driving part 35 to maintain the light emission ratio (duty cycle) of each LED at operation S7.

Thus, since the level of driving current applied to the backlight unit 33 is taken as a reference for adjusting color of the light emitted from the backlight unit 33, the color of the light may be adjusted even if the amount of light is decreased due to deterioration of the backlight unit 33.

As apparent from the above description, the present invention provides a display apparatus which is capable of adjusting color of light emitted from a backlight unit even if the amount of light is decreased due to deterioration or temperature of the backlight unit, based on a level of driving current applied to the backlight unit, and a control method thereof In addition, the present invention provides a display apparatus which is capable of stably adjusting color of light emitted from a backlight unit, and a control method thereof Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display apparatus having a displaying part on which an image is displayed, comprising:

a backlight unit comprising a plurality of light emitting elements that emit different color lights which illuminate the displaying part, the plurality of light emitting elements being arranged in a predetermined pattern;

a driving part that applies driving currents to the backlight unit to control an operation of the plurality of light emitting elements and intensities of lights emitted from the plurality of the light emitting elements;

a sensing part that senses an amount of light emitted from the backlight unit; and a controller that detects a level of one of the driving currents applied to the backlight unit by the driving part, and if the detected level of the one driving current exceeds a predetermined reference current level, controls the driving part to adjust the backlight unit based on the amount of light sensed by the sensing part.

2. The display apparatus according to claim 1, wherein the plurality of the light emitting elements comprise a red color light emitting diode, a green color light emitting diode, and a blue color light emitting diode, and wherein the controller controls the driving part to adjust at least one of an intensity of light emitted from the red color light emitting diode, an intensity of light emitted from the green color light emitting diode, and an intensity of light emitted from the blue color light emitting diode, based on the amount of light that is emitted from the backlight unit and is sensed by the sensing part.

3. The display apparatus according to claim 1, wherein the controller detects a level of driving current applied to a light emitting element, which is adjacent to the sensing part, of the plurality of light emitting diodes of the backlight unit.

4. The display apparatus according to claim 3, further comprising a signal input part to which an image signal is inputted, wherein the controller checks a gray scale of the inputted image signal and detects the level of driving current applied to the light emitting element adjacent to the sensing part, based on the checked gray scale.

5. The display apparatus according to claim 4, wherein the controller sets weights to the plurality of light emitting elements depending on distances from the sensing part, and detects the level of driving current applied to the light emitting element adjacent to the sensing part using the set weights and the gray scale for each illumination region of the backlight unit.

6. The display apparatus according to claim 1, wherein the controller sets weights to the plurality of light emitting elements depending on distances from the sensing part, and detects the level of driving current applied to the light emitting element adjacent to the sensing part using the set weights and a gray scale for each illumination region of the backlight unit.

7. The display apparatus according to claim 1, wherein, if a number of times in which the level of driving current exceeds the reference current level is more than a predetermined number, the controller controls the driving part to adjust the backlight unit.

8. The display apparatus according to claim 1, wherein, if a gray scale is less than a reference gray scale, the controller controls the driving part to maintain the level of driving current applied to the backlight unit.

9. A control method of a display apparatus having a displaying part on which an image is displayed, a backlight unit comprising a plurality of light emitting elements that emit different color lights which illuminates the displaying part, the plurality of light emitting elements being arranged in a predetermined pattern, a driving part that applies driving currents to the backlight unit to control operation of the plurality of light emitting elements and controls intensities of light emitted from the plurality of light emitting elements, and a sensing part that senses an amount of light emitted from the backlight unit, the control method comprising:

detecting a level of driving current applied to the backlight unit by the driving part;

comparing the detected level of driving current with a predetermined reference current level; and if the detected level of driving current exceeds the predetermined reference current level, controlling the driving part to adjust the backlight unit based on the amount of light sensed by the sensing part.

10. The control method according to claim 9, wherein the plurality of light emitting elements comprise a red color light emitting diode, a green color light emitting diode, and a blue color light emitting diode, and wherein the controlling the driving part comprises adjusting at least one of an intensity of light emitted from the red color light emitting diode, an intensity of light emitted from the green color light emitting diode, and an intensity of light emitted from the blue color light emitting diode, based on the amount of light that is emitted from the backlight unit and is sensed by the sensing part.

11. The control method according to claim 9, wherein the detecting the level of driving current comprises detecting a level of driving current applied to a light emitting element, which is adjacent to the sensing part, of the plurality of light emitting diodes of the backlight unit.

12. The control method according to claim 11, further comprising inputting an image signal, wherein the detecting the level of driving current comprises:

checking a gray scale of the inputted image signal; and detecting the level of driving current applied to the light emitting element adjacent to the sensing part, based on the checked gray scale.

13. The control method according to claim 12, wherein the detecting the level of driving current comprises:

setting weights to the plurality of light emitting elements depending on a distance from the sensing part; and detecting the level of driving current applied to the light emitting element adjacent to the sensing part using the set weights and the gray scale for each illumination region of the backlight unit.

14. The control method according to claim 9, wherein the detecting the level of driving current comprises:

setting weights to the plurality of light emitting elements depending on a distance from the sensing part; and detecting the level of driving current applied to the light emitting element adjacent to the sensing part using the set weights and a gray scale for each illumination region of the backlight unit.

15. The control method according to claim 9, wherein the controlling the driving part comprises adjusting the backlight unit if a number of times in which the level of driving current exceeds the reference current level is more than a predetermined number.

16. The control method according to claim 9, wherein the controlling the driving part comprises maintaining the level of driving current applied to the backlight unit if a gray scale is less than a reference gray scale.

17. The display apparatus according to claim 1, wherein the controller sets weights to the plurality of light emitting elements and detects the driving current using the weights and a gray scale for each illumination region of the backlight unit.

18. The control method according to claim 9, wherein the detecting the level of driving current comprises detecting the driving current, and wherein detecting the driving current comprises setting weights to at least one of the light emitting elements, and detecting the level of the driving current using the set weights and the gray scale.

19. The display apparatus according to claim 1, wherein the level of driving current is determined by multiplying the gray scale by the weight of the light emitting element and dividing by the sum of the weights of the plurality of light emitting elements.

20. The display apparatus according to claim 1, wherein if the detected level of the driving current does not exceed a predetermined level, the controller controls the driving part to maintain the amount of light sensed by the sensing part.

* * * * *